US009157707B2

(12) United States Patent
Li

(10) Patent No.: US 9,157,707 B2
(45) Date of Patent: Oct. 13, 2015

(54) CONTINUOUS FUSE STRUCTURE FOR COMBINATION FIREWORKS

(71) Applicant: Xinghua Li, Liuyang (CN)

(72) Inventor: Xinghua Li, Liuyang (CN)

( * ) Notice: Subject to any disclaimer, the term of this patent is extended or adjusted under 35 U.S.C. 154(b) by 32 days.

(21) Appl. No.: 14/151,957

(22) Filed: Jan. 10, 2014

(65) Prior Publication Data

US 2014/0224143 A1 Aug. 14, 2014

(51) Int. Cl.
*F42B 4/24* (2006.01)
*F42B 4/00* (2006.01)

(52) U.S. Cl.
CPC .... *F42B 4/24* (2013.01); *F42B 4/00* (2013.01)

(58) Field of Classification Search
CPC ..... F42B 4/00; F42B 4/02; F42B 4/04; F42B 4/14; F42B 4/24; F42B 4/26
USPC ..... 102/335, 336, 345, 352, 360, 361
See application file for complete search history.

(56) References Cited

U.S. PATENT DOCUMENTS

| | | | | | |
|---|---|---|---|---|---|
| 471,703 | A * | 3/1892 | Del Grande | ..... | 102/360 |
| 1,726,425 | A * | 8/1929 | De Blasio | ..... | 102/361 |
| 1,770,921 | A * | 7/1930 | Hitt | ..... | 102/360 |
| 1,922,156 | A * | 8/1933 | Fabrizio | ..... | 102/357 |
| 2,103,936 | A * | 12/1937 | Decker | ..... | 102/357 |
| 2,530,084 | A * | 11/1950 | Schermuly et al. | ..... | 102/345 |
| 4,325,304 | A * | 4/1982 | Ormiston | ..... | 102/200 |
| 7,051,657 | B2 * | 5/2006 | Yi et al. | ..... | 102/275.7 |
| 7,314,005 | B2 * | 1/2008 | Deye | ..... | 102/356 |
| 7,681,502 | B2 * | 3/2010 | Huang | ..... | 102/358 |
| 8,286,556 | B2 * | 10/2012 | Zhong et al. | ..... | 102/335 |
| 8,322,285 | B2 * | 12/2012 | Zhong et al. | ..... | 102/358 |

FOREIGN PATENT DOCUMENTS

EP 2781877 A1 * 9/2014

* cited by examiner

*Primary Examiner* — James S Bergin

(57) ABSTRACT

A combination fireworks device including at least one fire transmission unit including a plurality of single tubes placed in successive arrangement, wherein each of the plurality of single tubes includes a fire hole located on the tube side wall, and a single, continuous fuse connecting the plurality of single tubes to each other in series, wherein a portion of the fuse extends into the fire hole of each of the plurality of single tubes and the portion of the fuse includes a length of the fuse folded back onto itself in each fire hole.

15 Claims, 4 Drawing Sheets

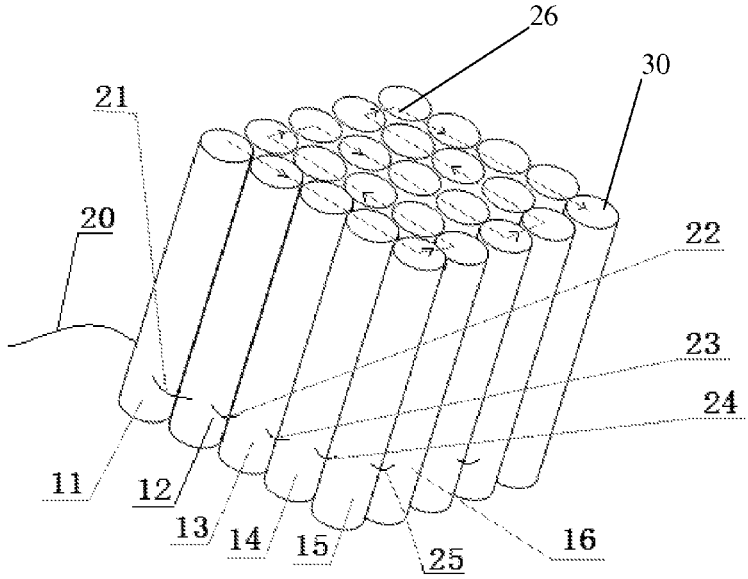
Fig. 1 - Prior Art
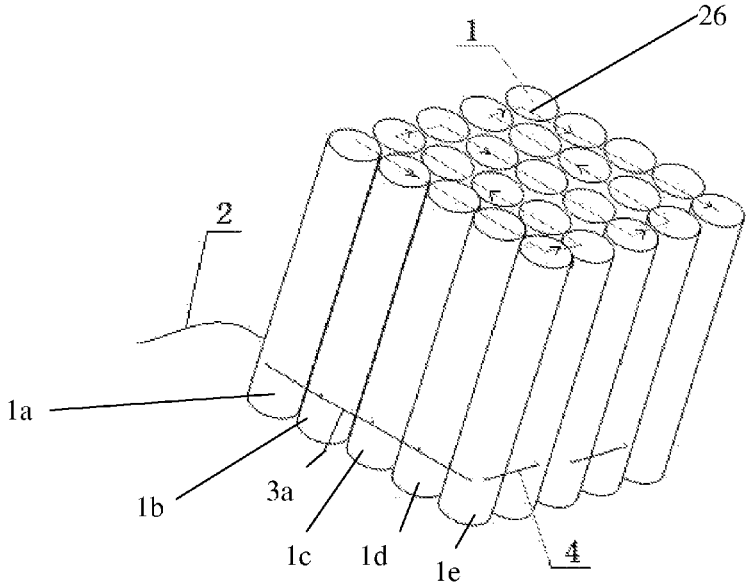
Fig. 2

CONTINUOUS FUSE STRUCTURE FOR COMBINATION FIREWORKS

CROSS REFERENCE TO RELATED APPLICATIONS

This application claims benefit of Chinese Application for a Patent for Invention Application No. 201310009200.9 entitled, "A combination of fireworks continuous lead structure," filed Jan. 10, 2013, and Chinese Utility Model Patent No. CN203053316A entitled, "A continuous fuse structure for combination fireworks," issued on Jul. 10, 2013, which is based on Chinese application no. 201320012679.7, filed Jan. 10, 2013, all of which are incorporated herein by reference in their entirety.

FIELD OF THE INVENTION

This invention relates to combination fireworks, and in particular to a fuse structure for combination fireworks and a method of manufacture.

BACKGROUND OF THE INVENTION

Chinese National Standard GB10631-2004 entitled "Fireworks and Firecracker—Safety and Quality", GB 19593-2004 entitled "Fireworks and Firecracker—Combination Fireworks" and other normative references govern the requirements for combination fireworks, which are a combination of a plurality of single tube fireworks devices. Usually, the structure is formed of a plurality of rows of paper tubes, such as rectangles, cylinders, diamond shapes and fan-shaped bodies. The paper tube chamber is stuffed with propellant powder and effects, which are ignited through the fuses. The fuse structure of prior art combination fireworks are typically made as follows. Two holes are drilled in each tube wall, one is the fire entry hole into which fire enters and the other is the fire hole or fire transmission hole out of which fire exits. The fuses are divided into several short parts. The tubes are connected together by inserting the respective ends of a fuse part into the fire hole of one tube and the fire entry hole of an adjacent tube.

For example, the prior art 25-shot products comprise 5 tube rows X 5 single tubes per tube row as shown FIG. 1. The transfer order is in accordance with the fire lines 26 marked with arrows. The first tube row comprises the head-end of the paper tube series, starting with tube 11, followed in sequence by adjacent tubes 12, 13, 14 and 15. The long ignition fuse 20 is inserted into the fire entry hole (not shown) of tube 11. Tube 12 is adjacent to tube 11. The fire hole of tube 11 and fire entry hole of tube 12 are connected by inserting therein the two ends of short fuse 21. Tube 13 is adjacent to tube 12. In a similar manner, the fire hole of tube 12 and fire entry hole of tube 13 are connected by inserting therein into the two ends of short fuse 22. Tube 14 is adjacent to tube 13. The fire hole of tube 13 and fire entry hole of tube 14 are connected by inserting therein into the two ends of short fuse 23. Tube 15 is adjacent to tube 14. The fire hole of tube 14 and fire entry hole of tube 15 are connected by inserting therein into the two ends of short fuse 24.

Tube 16, which is located adjacent tube 15 is the first tube of the next row. To join the next adjacent row, the fire hole of tube 15 and fire entry hole of tube 16 are connected by inserting therein the two ends of short fuse 25, forming an inter-row fire transmission, and so on. A second long fuse (not shown) is inserted into the fire hole of tube 30, which is located at the end of the last row. The second long fuse is used as a spare ignition fuse.

In the illustrated prior art fuse structure, the fire-order is as follows: 1) ignition of fuse 20; 2) the propellant powder in tube 11 ignites short fuse 21 out of fire hole of tube 11 and into fire entry hole of tube 12; 3) the propellant powder in tube 12 ignites short fuse 22 out of fire hole of tube 12 and into fire entry hole of tube 13, and so on until the series ends.

In case there is a fault in firing, the spare ignition fuse can be ignited for a second ignition at tube 30, which is in a reverse fire transmission order. In this situation, the fire holes have the function of fire entry holes and vice versa.

There are several drawbacks to the prior art fuse structure. First, there is a lack of reliability in fire transmission and ignition. The potential of eliminating fire transmission failures is very low as the plurality of short fuses are connected but not as a singular fuse, particularly in each paper tube chamber where failures too frequently occur. Misfiring occurs once a fault has taken place at any fire transmission point, which not only leads to a firing failure affecting the fireworks display, but also may cause accidents during post-failure inspection. Second, to form a prior art fuse structure, it is necessary to cut a long fuse into multiple small parts. As the long fuse is covered by a cladding made of gunpowder, the cutting undermines the fuses lumen gunpowder distribution, and impacts the fire transmission performance. In addition, gunpowder contact is inevitable during the manual or mechanical cutting process, which is dangerous. Third, the procedure for processing traditional fuse structures is complicated and inefficient. Besides fuse cutting, punching or drilling (twice) in each tube and insertion of the short fuses are also required, and have to be done manually. During the fuse insertion process, soft and short fuses are inserted into the small holes of two adjacent tubes, which are difficult to be conducted reliably and efficiently by mechanical processes.

To overcome the problems of the prior art, an improved fuse structure for combination fireworks is needed.

SUMMARY OF THE INVENTION

In order to address the above drawbacks, there is provided a continuous fuse structure for combination fireworks, which is reliable in fire transmission and ignition, and simple and convenient in production and processing. The continuous fuse structure for combination fireworks comprises two or more single tubes, each tube comprising one or more fire units. Each of the two or more single tubes has at least one fire hole located on the tube side wall. Fire passes along a long segment fuse throughout each of the at least one fire hole of the two of more single tubes and each of the one or more fire units. The long segment fuse joins adjacent tubes together, a portion of the fuse being folded and inserted into each tube in at least one fire hole.

Optionally, adjacent tubes in a second or subsequent rows are connected either with a separate connecting fuse or a connecting part of the same fuse. According to the fire-sequence, each folded portion of the fuse is sequentially inserted in the at least one fire hole of each single tube. In embodiments of combination fireworks comprising multiple fire units, the flame spreads along the fuse or fuses through the separate fire units and tubes.

In a first embodiment comprising a plurality of tubes in a row, one fuse joins all the tubes, each tube comprising one fire hole, with a portion of the fuse being folded back onto itself and inserted into each fire hole.

In a second embodiment, comprising a plurality of rows of tubes, the end-tube of one row is connected to the head-tube of an adjacent row with a connecting fuse, the end-tube and head-tubes being adjacent each other. Each tube comprises at least one fire hole, the connecting fuse joining the end-tube and head-tube.

In a third embodiment, the end-tube and head-tube each have two fire holes, one fire hole being to connect the tubes in the same row with a fuse and the other fire hole to connect the end-tube and head-tube with a connecting fuse.

In a fourth embodiment, each row has two or more fuses connecting adjacent tubes. Each tube in the row can have one or more fire holes.

In a fifth embodiment, all tubes in all rows are connected with one continuous fuse, each tube having one fire hole. The end-tube of one row and head-tube of the next row are connected.

A method of constructing a continuous fuse structure for combination fireworks is further disclosed, comprising the steps of positioning two or more tubes in a row, pasting a continuous bottom paper to the row, the bottom paper covering at least a part of each tube, punching at least one hole in each tube through the bottom paper, providing a fuse which is longer than the width of the two or more tubes, inserting a folded segment or portion of fuse in each hole, and pasting a continuous surface paper on top of the fuse and continuous bottom paper, the continuous surface paper covering the exposed portions of the fuse and forming a fire channel.

The invention has several advantages. The fuse of the entire combination fireworks can be comprised of one or more parallel and continuous fuses, which means the entire combination fireworks can be joined by one fire transmission unit. There is no need to cut smaller fuse segments in the fire transmission unit, resulting in less gun powder waste and higher safety. In some embodiments, only one punched or drilled hole per tube is required. The process of fuse insertion is simplified, which allows for reliable, highly efficient mechanical production. Fire is transmitted between adjacent tubes through a continuous fuse as opposed to prior art point-to-point fire transmission. In one embodiment, two parallel roundabout fuses are adopted for in-tube ignition and fire transmission, and the two fuses are connected at the corner in the tube and approach closely in the fire transmission hole. Once the fuse is lit, the fire sources are ignited one by another, forming an ignition surface clear of ignition dead spaces, thereby reducing or completely eliminating the occurrence of misfires, and resulting in higher or total ignition rates for the combination fireworks.

In addition, the ignition speed of each single tube is controlled at the outer part of the successive fuse, which excludes the probability of fire transmission in the single tube, and also greatly improves the timing and reliability of the fireworks, which is particularly important for products requiring high ignition timing accuracy. Therefore, the beneficial effects of this invention include reliable and accurate ignition and fire transmission, and simplified production and processing.

In embodiments where the fire transmission unit comprises a number of successive adjacent single tubes, the "number" of tubes refers to the single tube number, which may be two, three, four, etc. . . . and the maximum number depends on the number of combination fireworks. Preferably, the fire transmission unit comprises at least three consecutive adjacent single tubes.

Generally, the combination fireworks are formed by several rows, each row comprising several single tubes. In order to maintain the compatibility with the original process and reduce the difficulty of the process, preferably, each tube row of the combination fireworks forms a fire transmission unit, and the plurality of fire transmission units are connected by connector fuses. Of course, in accordance with the needs of the set off design, each tube row can be split into a number of fire transmission units.

To improve the ignition reliability, preferably, the fire transmission unit has a row connecting fuse with two folded portions, each of the two folded portions being inserted into the respective fire hole of an end-tube and head-tube at a specific connection position of the two fire transmission units. To improve the reliability of fire, as a further preferable choice, the fire entry hole and the fire transmission hole is the same hole.

In order to prevent the occurrence of cross-firing, and improve the moisture-proof and anti-damage performance of the combination fireworks, the fuse joining tubes in each single tube row of the combination fireworks are disposed between a bottom paper layer and a surface paper layer, which are continuous paper layers. Each tube row forms one fire transmission unit, the fuse connecting the single tubes in the row. Row connecting fuses join two adjoining fire transmission units.

An exemplary embodiment of the invention provides a combination fireworks device including at least one fire transmission unit comprising a plurality of single tubes placed in successive arrangement, wherein each of the plurality of single tubes comprises a fire hole located on the tube side wall, and a single, continuous fuse connecting the plurality of single tubes to each other in series, wherein a portion of the fuse extends into the fire hole of each of the plurality of single tubes and the portion of the fuse is a length of said fuse folded back onto itself in each fire hole.

In a feature of this embodiment, the at least one fire transmission unit is a plurality of fire transmission units, each of the plurality of fire transmission units including a head-unit and an end-unit, the head-unit and end unit of each fire transmission unit further including a second fire hole. The device further includes a second fuse connecting the end-unit and the head-unit of adjacent fire transmission units, wherein a portion of the second fuse extends into the second fire hole of each end-unit and head unit of adjacent fire transmission units, in series. The portion of the second fuse includes a length of the second fuse folded back onto itself in each second fire hole.

In another feature of this embodiment, the at least one fire transmission unit includes a plurality of fire transmission units, each of the plurality of fire transmission units comprising a head-unit and an end-unit, and the fuse connects each end-unit and head unit of adjacent fire transmission units.

In a further feature of this embodiment, the at least one fire transmission unit includes a plurality of fire transmission units, each of the plurality of fire transmission units including a head-unit and an end-unit. The device further includes a second fuse connecting the end-unit and the head-unit of adjacent fire transmission units, wherein a portion of the second fuse extends into the fire hole of each end-unit and head unit of adjacent fire transmission units in series, wherein the portion of the second fuse comprises a length of said second fuse folded back onto itself in each fire hole. Preferably, the device further includes at least two adjacent rows, each of the rows including at least two of the plurality of fire transmission units, wherein each of the rows includes a head-unit and an end-unit, the head-unit and end-unit of each of the rows further includes a second fire hole, and a third fuse connecting the end-unit and the head-unit of adjacent rows, wherein a portion of the second fuse extends into the second fire hole of each the end-unit and head-unit of adjacent rows, and the portion of the third fuse includes a length of the third fuse folded back onto itself in each second fire hole.

In a still further feature of this embodiment, the device also includes a first continuous paper layer attached to the fire transmission unit connecting the single tubes, and a second continuous paper layer attached to the first continuous paper layer, wherein the fuse is disposed between the first paper layer and said second paper layer. Preferably, the device further includes a hole punched through the first paper layer and into each of the single tubes to create the fire hole.

In another exemplary embodiment of the invention, there is provided a combination fireworks device including a fire transmission unit including a plurality of single tubes placed in successive arrangement, wherein each of the plurality of single tubes includes a fire hole located on the tube side wall, and a single, continuous fuse connecting the plurality of single tubes to each other in series, wherein a portion of the fuse extends into the fire hole of each of the plurality of single tubes and the portion of the fuse includes a length of the fuse folded back onto itself in each fire hole.

In a feature of this embodiment, the device further includes a second fire transmission unit adjacent to the first fire transmission unit including a plurality of single tubes placed in successive arrangement, wherein the first fire transmission unit and the second fire transmission unit each comprise a head-unit and an end-unit, the head-unit and end-unit of each fire transmission unit further including a second fire hole, and a second fuse connecting the end-unit of the first fire transmission unit and the head-unit of the second fire transmission unit, wherein a portion of the second fuse extends into the second fire hole of each end-unit and head unit of adjacent fire transmission units, wherein the portion of the second fuse includes a length of the second fuse folded back onto itself in each second fire hole.

In another feature of this embodiment, the device further includes a second fire transmission unit adjacent to the first fire transmission unit including a plurality of single tubes placed in successive arrangement, wherein the first fire transmission unit and the second fire transmission unit each include a head-unit and an end-unit, wherein the fuse further connects the end-unit of the first fire transmission unit and the head-unit of the second fire transmission unit, wherein a portion of the fuse extends into the fire hole of the end-unit of the first fire transmission unit and the head-unit of the second fire transmission unit, wherein the portion of the fuse includes a length of the fuse folded back onto itself in each fire hole.

In a further feature of this embodiment, the device further includes a first continuous paper layer attached to the fire transmission unit connecting the single tubes, and a second continuous paper layer attached to the first continuous paper layer, wherein the fuse is disposed between the first paper layer and the second paper layer.

In yet another exemplary embodiment of the invention, there is provided a continuous fuse structure for combination fireworks including a plurality of single tubes placed in successive arrangement so as to form an array, one or more of the plurality of single tubes comprising a fire unit, each of the plurality of single tubes comprising at least one fire hole located on the tube side wall, one or more fuses for connecting adjacent single tubes to each other, a first portion of the one or more fuses extending into the at least one fire hole of a first single tube and a second portion of the same one or more fuses extending into the at least one fire hole of a second single tube, the first and second single tubes being adjacent each other, so as to connect in series all the single tubes of the array, wherein each of the first and second portions of the one or more fuses is folded back onto itself in each of the at least one fire hole.

In a feature of this embodiment, the device further includes one or more of the plurality of single tubes including a second fire unit adjacent to the first fire unit, wherein the first fire unit and the second fire unit each include a head-unit and an end-unit, the head-unit and end-unit of each fire unit further includes a second fire hole, a second fuse connecting the end-unit of the first fire unit and the head-unit of the second fire unit, wherein a first portion of the second fuse extends into the second fire hole of the end-unit of the first fire unit and a second portion of the second fuse extends into the second fire hole of the head-unit of the second fire unit, wherein each of the first and second portions of the second fuse is folded back onto itself in each of the second fire holes.

In another feature of the embodiment, the device further includes one or more of the plurality of single tubes making a second fire unit adjacent to the first fire unit, wherein the first fire unit and said second fire unit each include a head-unit and an end-unit, wherein the first portion of the one or more fuses extending into the at least one fire hole of the end-unit of the first fire unit and the second portion of the same one or more fuses extends into the at least one fire hole of the head-unit of the second fire unit, wherein each of the first and second portions of the one or more fuses is folded back onto itself in each of the at least one fire hole.

In a further feature of the embodiment, the device further includes a first continuous paper layer attached to the fire unit connecting the single tubes of the fire unit, and a second continuous paper layer attached to the first continuous paper layer, wherein the one or more fuses are disposed between the first paper layer and the second paper layer.

These and other exemplary features and advantages of the present invention will become clear from the following description with reference to the accompanying drawings.

BRIEF DESCRIPTION OF THE DRAWINGS

The foregoing and other exemplary purposes, aspects and advantages will be better understood from the following detailed description of exemplary embodiments of the invention with reference to the drawings. Embodiments are illustrated by way of example and not limitation in the following figures, in which like references indicate similar elements.

FIG. 1 is a structure diagram for a typical prior art 25-shot combination fireworks;

FIG. 2 is a structure diagram for a first embodiment of the present invention;

DETAILED DESCRIPTION OF THE DRAWINGS

Example embodiments, as described below, may be used to provide a fuse structure for combination fireworks and a method of manufacture.

Figure 3:
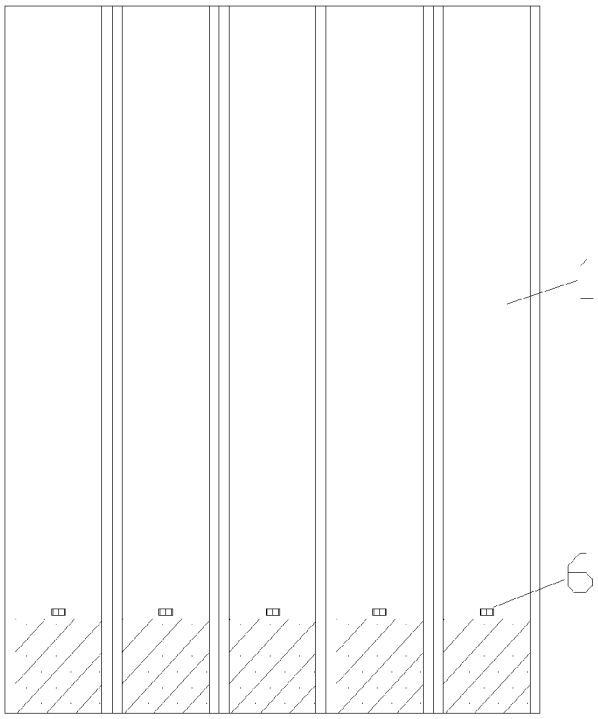
FIG. 3 is a longitudinal sectional diagram for the embodiment of FIG. 2 of the present invention.
Figure 4:
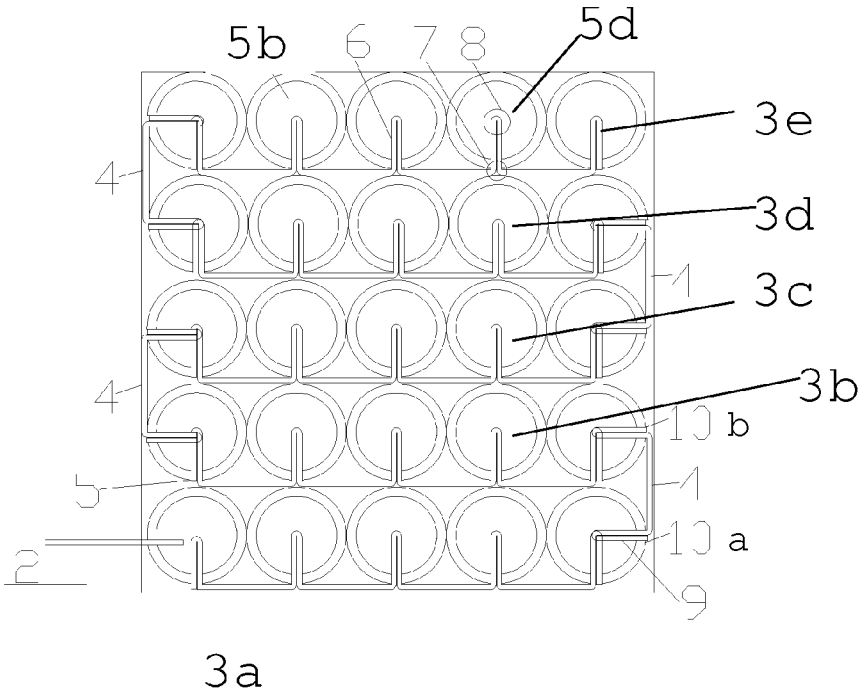
FIG. 4 is a cross-sectional diagram for the embodiment of FIG. 2 of the present invention.

A first embodiment is illustrated in FIGS. 2-4. The specific structure of this invention, illustrated as a 25-shot combination fireworks, may equally be applied to smaller or larger-shot combination fireworks as described herein. The illustrated embodiment comprises 5 tube rows X 5 single tubes per row, ignited by ignition fuse 2. The transfer order is in accordance with the fire line 26 marked with arrows in FIG. 2. Other embodiments may include 2×2, 3×3, 4×4, 7×7, etc. tube arrays and further may include 2×3, 3×2, 2×4, 4×2, etc. combinations, as will be appreciated.

As illustrated, the combination fireworks include five fire transmission units. Five single tubes 1*a*, 1*b*, 1*c*, 1*d*, 1*e* in each tube row form one fire transmission unit. On the side walls of each single tube is a fire transmission hole 5, as shown in FIG. 4. Fire spreads along a continuous long fuse 3*a* which extends between each single tube of the first fire transmission unit. As illustrated, further long fuses 3*b*, 3*c*, 3*d*, 3*e* extend between each single tube of the other fire transmission units in a similar manner as long fuse 3*a*. In embodiments comprising n fire transmission units, there are n long fuses joining the single tubes in each of the n fire transmission units.

Each of long fuses 3*a*, 3*b*, 3*c*, 3*d*, 3*e* joins the single tubes in a similar manner. As shown in the top fire transmission unit of FIG. 4, long fuse 3*e* is folded and inserted into each of the five single tubes' respective fire transmission hole 5 (see position 6). FIG. 3 shows a longitudinal sectional view with the parallel segments 6 of the folded long fuse for a given tube 1 in a fire transmission unit.

The end-unit of one fire transmission unit or row is coupled to the head-unit of the next fire-transmission unit or row. With reference to the fuse connection between the first and second fire transmission units of FIG. 4, row connecting fuse 4 comprises two folded portions 9, the first folded portion 9 is inserted in the end-unit at fire transmission hole 10*a*, and the second folded portion 9 is inserted in the adjacent head-unit at fire transmission hole 10*b*. Similar connecting fuses 4 join the other end-unit tubes to adjacent head-unit tubes. As can be seen from FIG. 4, there is no need to cut small fuses in the fire units, and only one punched or drilled hole is required in most of the tubes. In comparison with prior art point-to-point fire transmission, FIG. 4 shows how fire is transmitted through the continuous fuses.

For ease of understanding, the tubes in the first row are referred to as 1*a*, 1*b*, 1*c*, etc. The tubes in the second row (not numbered in FIG. 5) would be referred to 2*a*, 2*b*, 2*c*, etc. As such, the second tube in the fifth row is identified as 5*b*. As shown in tube 5*d*, two parallel portions of long fuse 3*e* are folded and formed for insertion in fire transmission hole 7 (circled inner portion), the bend shown within tube 5*d* at bend location 8 (circled inner portion). Once the fuse is lit, the fire sources are ignited one after another, forming an ignition surface free of ignition dead spots.

Figure 5:
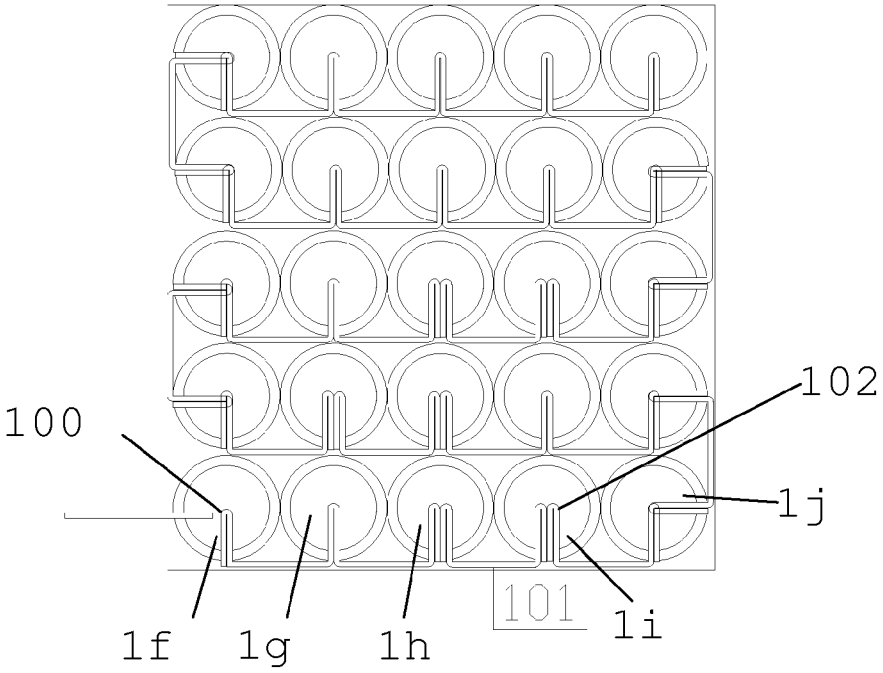
FIG. 5 is a cross-sectional diagram for a second embodiment of the present invention.

A second embodiment is illustrated in FIG. 5. Compared to the first embodiment where each of the five tubes in a fire transmission unit is coupled by one long fuse, FIG. 5 illustrates two or more tubes within a given fire transmission unit coupled together by fuses that are shorter in length than a long fuse. In the first row, there are two fire transmission units, namely a first fire transmission unit comprising tubes 1*f*, 1*g*, and 1*h* and a second fire transmission unit comprising tubes 1*i* and 1*j*. A first fuse 100 joins tubes if to 1*g* and tubes 1*g* to 1*h*. A second fuse 102 connects tube 1*i* to tube 1*j* only. A unit connecting fuse 101 joins the two fire transmission units as it is inserted in tube 1*h* of the first fire transmission unit and tube 1*i* of the second fire transmission unit. Fire spreads between fire transmission units since unit connecting fuse 101 shares fire holes with tubes of each adjacent fire transmission unit. In another embodiment, tubes on the end of adjoining fire transmission units may be designed with separate fire transmission holes for the unit connecting fuses. As illustrated in this embodiment, not all the rows require the same number of fire transmission units. The rows that have two fire transmission units must have connector fuses joining adjoining fire transmission units.

Figure 6:
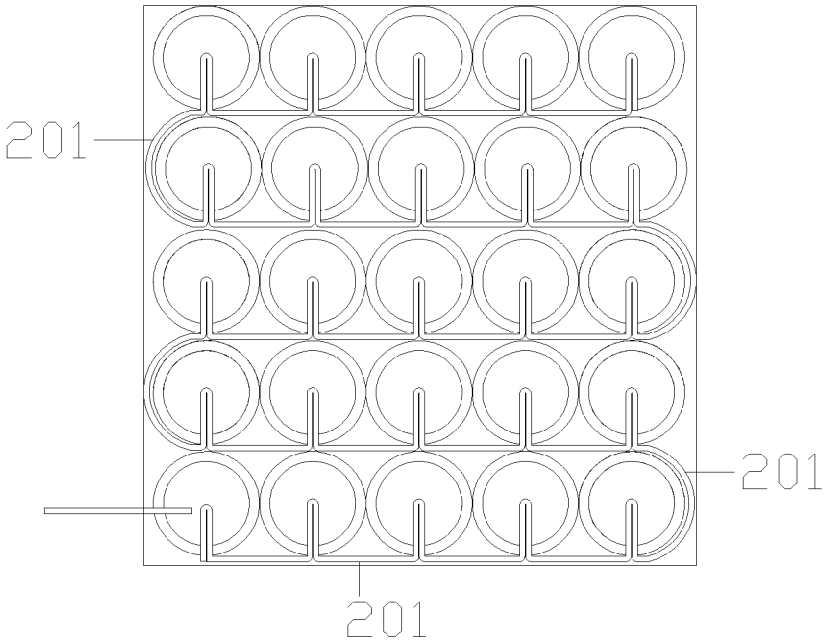
FIG. 6 is a cross-sectional diagram for a third embodiment of the present invention.

A third embodiment is illustrated in FIG. 6. Compared to the first embodiment where each of the five tubes in a fire transmission unit is coupled by one long fuse and the resulting array has five long fuses, FIG. 6 illustrates a combination fireworks comprising only one fire transmission unit, and only one continuous fuse 201 is used for fire transmission through single tubes and the five tube rows. An end-unit tube is connected to an adjacent head-unit tube with a segment of continuous fuse 201 which wraps around end-unit tube, in the illustrated embodiment. Depending on the number of tubes and placements, it is contemplated for the joining segment to be of different lengths and orientations. In this embodiment, the terms "end-unit" and "head-unit" are in relation to the configuration (eg: the 5×5 array) since there is only one fire transmission unit.

In the first three embodiments, the single tubes are connected in series, such that when the long fuse 2 in FIGS. 2 and 4 is ignited, the fire unit in the first tube is ignited, fuse 3*a* is ignited, the fire unite in the second tube is ignited, fuse 3*b* is ignited and so on. After the last tube in the first row, namely the fifth tube 1*e* in the illustrated embodiment, is ignited, connecting fuse 4 is ignited, which ignites the first tube in the second row. Each adjacent tube ignites in series.

Figure 7:
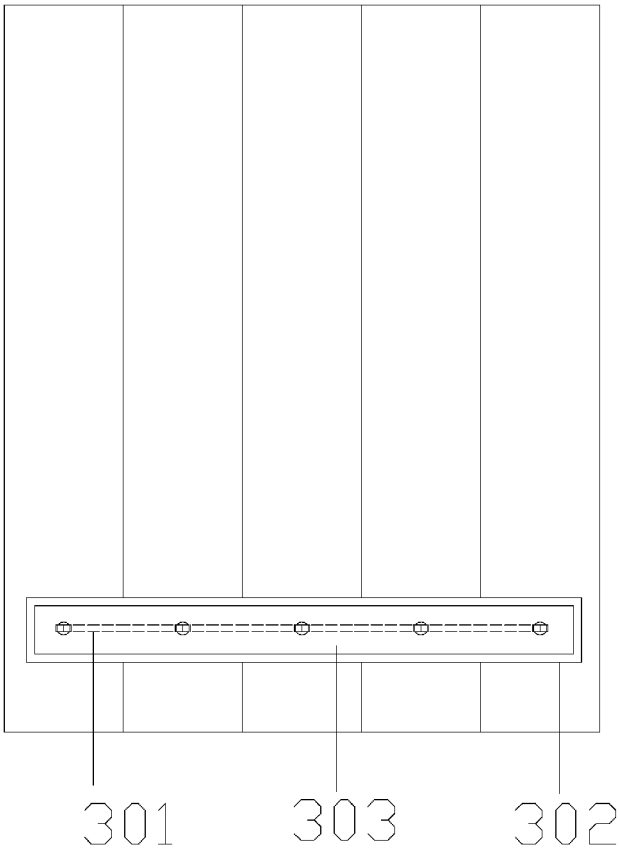
FIG. 7 is a front view illustration of a fourth embodiment of the present invention.

A fourth embodiment is illustrated in FIG. 7, which shows a front view of the fire transmission unit's five tubes. Fuse 301, shown in broken lines, is disposed between bottom paper layer 302 and surface paper layer 303, and is therefore hidden from view. Bottom paper layer 302 and surface paper layer 303, which are continuous paper layers, cover at least a part of each single tube of the fire transmission unit. During manufacture, continuous bottom paper layer 302 is pasted at the specified fuse inserting position on the surface of the tube rows. In the illustrated example, the position is the lower part of the tubes. A hole is punched into each tube through continuous bottom paper layer 302. Segments of fuse 301 are then inserted into each hole with folded portions as described above. Then the continuous surface paper layer 303 is pasted on top of fuse 301.

The two joined continuous paper layers form a closed space for fuse 301, which becomes a fire channel. In this embodiment, the occurrence of cross-firing is prevented. Furthermore, moisture exposure is reduced and performance of fuse 301 is increased.

The described embodiments for the invention are provided to clearly illustrate the invention of new technical solutions, and thus are not be understood as restrictions to the invention, which are limited by the following claims While the invention has been described in terms of several exemplary embodiments, those skilled in the art will recognize that the invention can be practiced with modification within the spirit and scope of the appended claims.

Further, it is noted that, Applicant's intent is to encompass equivalents of all claim elements, even if amended later during prosecution.

What is claimed is:

1. A combination fireworks device comprising:

at least one fire transmission unit comprising a plurality of single tubes placed in successive arrangement, wherein each of the plurality of single tubes comprises a fire hole located on the tube side wall; and a single, continuous fuse connecting said plurality of single tubes to each other in series, wherein a portion of said fuse extends into the fire hole of each of said plurality of single tubes and said portion of said fuse comprises a length of said fuse folded back onto itself in each fire hole.

2. The combination fireworks device of claim 1, wherein said at least one fire transmission unit comprises a plurality of fire transmission units, each of said plurality of fire transmission units comprising a head-unit and an end-unit, the head-unit and end unit of each fire transmission unit further comprising a second fire hole; and further comprising a row connecting fuse connecting the end-unit and the head-unit of adjacent fire transmission units, wherein a portion of said row connecting fuse extends into the second fire hole of each said end-unit and head unit of adjacent fire transmission units, wherein said portion of said row connecting fuse comprises a length of said row connecting fuse folded back onto itself in each second fire hole.

3. The combination fireworks device of claim 1, wherein said at least one fire transmission unit comprises a plurality of fire transmission units, each of said plurality of fire transmission units comprising a head-unit and an end-unit, and said fuse connects each of said end-unit and head unit of adjacent fire transmission units.

4. The combination fireworks device of claim 1, wherein said at least one fire transmission unit comprises a plurality of fire transmission units, each of said plurality of fire transmission units comprising a head-unit and an end-unit; and further comprising a unit connecting fuse connecting the end-unit and the head-unit of adjacent fire transmission units, wherein a portion of said unit connecting fuse extends into the fire hole of each said end-unit and head unit of adjacent fire transmission units, wherein said portion of said unit connecting fuse comprises a length of said unit connecting fuse folded back onto itself in each fire hole.

5. The combination fireworks device of claim 4, further comprising:

at least two adjacent rows, each of said rows comprising at least two of said plurality of fire transmission units, wherein each of said rows comprises a head-unit and an end-unit, the head-unit and end unit of each of the rows further comprises a second fire hole; and a row connecting fuse connecting the end-unit and the head-unit of adjacent rows, wherein a portion of said row connecting fuse extends into the second fire hole of each said end-unit and head unit of adjacent rows, wherein said portion of said row connecting fuse comprises a length of said row connecting fuse folded back onto itself in each second fire hole.

6. The combination fireworks device of claim 1, further comprising:

a first continuous paper layer attached to said fire transmission unit connecting said single tubes; and a second continuous paper layer attached to said first continuous paper layer, wherein said fuse is disposed between said first paper layer and said second paper layer.

7. The combination fireworks device of claim 6, further comprising a hole punched through said first paper layer and into each of the single tubes to create said fire hole.

8. A combination fireworks device comprising:

a fire transmission unit comprising a plurality of single tubes placed in successive arrangement, wherein each of the plurality of single tubes comprises a fire hole located on the tube side wall; and a single, continuous fuse connecting said plurality of single tubes to each other in series, wherein a portion of said fuse extends into the fire hole of each of said plurality of single tubes and said portion of said fuse comprises a length of said fuse folded back onto itself in each fire hole.

9. The combination fireworks device of claim 8, further comprising:

a second fire transmission unit adjacent to said fire transmission unit comprising a plurality of single tubes placed in successive arrangement, wherein said fire transmission unit and said second fire transmission unit each comprise a head-unit and an end-unit, the head-unit and end-unit of each fire transmission unit further comprising a second fire hole; and a unit connecting fuse connecting the end-unit of said fire transmission unit and the head-unit of said second fire transmission unit, wherein a portion of said unit connecting fuse extends into the second fire hole of each said end-unit and head unit of adjacent fire transmission units, wherein said portion of said unit connecting fuse comprises a length of said unit connecting fuse folded back onto itself in each second fire hole.

10. The combination fireworks device of claim 8, further comprising, a second fire transmission unit adjacent to said fire transmission unit comprising a plurality of single tubes placed in successive arrangement, wherein said fire transmission unit and said second fire transmission unit each comprise a head-unit and an end-unit, wherein said fuse further connects the end-unit of said fire transmission unit and the head-unit of said second fire transmission unit, wherein a portion of said fuse extends into the fire hole of the end-unit of said fire transmission unit and the head-unit of said second fire transmission unit, wherein said portion of said fuse comprises a length of said fuse folded back onto itself in each fire hole.

11. The combination fireworks device of claim 8, further comprising:

a first continuous paper layer attached to said fire transmission unit connecting said single tubes; and a second continuous paper layer attached to said first continuous paper layer, wherein said fuse is disposed between said first paper layer and said second paper layer.

12. A continuous fuse structure for combination fireworks, comprising:

a plurality of single tubes placed in successive arrangement so as to form an array, one or more of the plurality of single tubes comprising a fire unit, each of the plurality of single tubes comprising at least one fire hole located on the tube side wall;

one or more fuses for connecting adjacent single tubes to each other;

a first portion of the one or more fuses extending into the at least one fire hole of a first single tube and a second portion of the same one or more fuses extending into the at least one fire hole of a second single tube, the first and second single tubes being adjacent each other, so as to connect in series all the single tubes of the array;

wherein each of the first and second portions of the one or more fuses is folded back onto itself in each of the at least one fire hole.

13. The combination fireworks device of claim 12, further comprising:

one or more of the plurality of single tubes comprising a second fire unit adjacent to said fire unit, wherein said fire unit and said second fire unit each comprise a head-unit and an end-unit, the head-unit and end-unit of each fire unit further comprising a second fire hole; and a unit connecting fuse connecting the end-unit of said fire unit and the head-unit of said second fire unit, wherein a first portion of the unit connecting fuse extends into the second fire hole of the end-unit of said fire unit and a second portion of the unit connecting fuse extends into the second fire hole of the head-unit of said second fire unit, wherein each of the first and second portions of the unit connecting fuse is folded back onto itself in each of the second fire holes.

14. The combination fireworks device of claim 12, further comprising, one or more of the plurality of single tubes comprising a second fire unit adjacent to said fire unit, wherein said fire unit and said second fire unit each comprise a head-unit and an end-unit, wherein the first portion of the one or more fuses extending into the at least one fire hole of the end-unit of said fire unit and the second portion of the same one or more fuses extends into the at least one fire hole of the head-unit of said second fire unit, wherein each of the first and second portions of the one or more fuses is folded back onto itself in each of the at least one fire hole.

15. The combination fireworks device of claim 12, further comprising:

a first continuous paper layer attached to said fire unit connecting said single tubes of said fire unit; and a second continuous paper layer attached to said first continuous paper layer, wherein said one or more fuses are disposed between said first paper layer and said second paper layer.

* * * * *